US008640276B2

(12) United States Patent
Ingram et al.

(10) Patent No.: US 8,640,276 B2
(45) **Date of Patent: *Feb. 4, 2014**

(54) WATER-PROOF JOINT FOR TUB AND SHOWER SURROUNDS

(75) Inventors: Scott Ingram, Lasalle (CA); Brent Thomas, Enville, TN (US)

(73) Assignee: Aqua Glass Corporation, Moorestown, NJ (US)

( * ) Notice: Subject to any disclaimer, the term of this patent is extended or adjusted under 35 U.S.C. 154(b) by 1157 days.

This patent is subject to a terminal disclaimer.

(21) Appl. No.: 12/056,485

(22) Filed: Mar. 27, 2008

(65) Prior Publication Data

US 2008/0172785 A1 Jul. 24, 2008

Related U.S. Application Data

(63) Continuation of application No. 10/325,540, filed on Dec. 19, 2002.

(51) Int. Cl.
*A47K 3/02* (2006.01)
*A47K 3/00* (2006.01)

(52) U.S. Cl.
CPC ..... *A47K 3/00* (2013.01)
USPC ..... 4/584

(58) Field of Classification Search
CPC ..... A47K 3/00
USPC ..... 4/584
See application file for complete search history.

(56) References Cited

U.S. PATENT DOCUMENTS

| | | | | |
|---|---|---|---|---|
| 3,605,352 | A | 9/1971 | Ruggles et al. | |
| 3,800,335 | A | 4/1974 | Buonaura | |
| 3,827,086 | A | 8/1974 | Seymour et al. | |
| 4,671,026 | A | 6/1987 | Wissinger | |
| 4,893,450 | A | 1/1990 | Donaldson et al. | |
| 5,159,723 | A | 11/1992 | Benedict | |
| 5,311,707 | A | 5/1994 | LaRoche et al. | |
| 5,671,489 | A | 9/1997 | Salach | |
| 5,870,878 | A | 2/1999 | Swingle | |
| 5,950,370 | A | 9/1999 | Peck | |
| 5,983,583 | A | 11/1999 | Mattix et al. | |
| 7,424,754 | B2 * | 9/2008 | Ingram et al. | 4/584 |

* cited by examiner

*Primary Examiner* — Lori Baker
(74) *Attorney, Agent, or Firm* — Carlson, Gaskey & Olds, PC

(57) ABSTRACT

A molded tub and surround which is formed of a multiple of portions. Wall portions meet a tub portion at a joint with a retaining ledge which extends inward toward a tub bowl from a flange. A ledge interface within the bottom of the wall portions engages the ledge. An angled interface surface is located directly in front of the ledge and slopes downward toward the bowl. A shallow interface within the bottom of the wall portions engages the angled interface surface.

13 Claims, 2 Drawing Sheets

WATER-PROOF JOINT FOR TUB AND SHOWER SURROUNDS

This application is a continuation application of U.S. patent application Ser. No. 10/325,540, filed on Dec. 19, 2002.

BACKGROUND OF THE INVENTION

The present invention relates to a waterproof joint between two portions of a molded plastic tub surround.

Tub and shower surrounds are positioned within a recess built around a bathtub or shower. Conventional modular tub/shower units often include a tub portion at the bottom and two or more wall portions. The whole structure is inserted into the wall recess to form a waterproof surround. The fully enclosed waterproof structure is highly advantageous in that it prevents the escape of water into the wall cavity despite the shower spraying water onto the surrounding walls.

One problem which has always arisen with products of this type is that of forming a suitable joint between the tub surround portions. Various styles of joint have been used, each of which providing particular tradeoffs in complexity, aesthetics, and sealing ability.

Accordingly, it is desirable to provide a waterproof joint between a wall portion for a molded plastic tub surround which is uncomplicated and aesthetically pleasing while assuring an effective watertight seal.

SUMMARY OF THE INVENTION

The present invention provides a joint for a molded tub and surround which is formed of a multiple of portions. A tub portion receives wall portions to form the combined tub and surround. The tub portion defines a horizontal deck area with a retaining ledge which extends inward toward the tub bowl from a flange.

A ledge interface within the bottom of the wall portions engages the retaining ledge. The weight of the wall portions compress a caulking compound to fill any potential voids therebetween. The height of the ledge further provides a barrier to prevent water from pooling behind the wall portions during and after usage. The retaining ledge operates to resist pressure exerted upon the lower portion of the wall portions such as, for example only, should a person push upon the wall portions.

An angled interface surface is located directly in front of the ledge and slopes downward toward the bowl. A shallow interface within the bottom of the wall portions engages the angled interface surface.

The retaining ledge and the angled interface surface assures an effective watertight molded tub and surround which is effectively invisible when installed.

The present invention therefore provides a waterproof joint between a wall portion and tub portion of a molded plastic tub surround which is uncomplicated and aesthetically pleasing.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
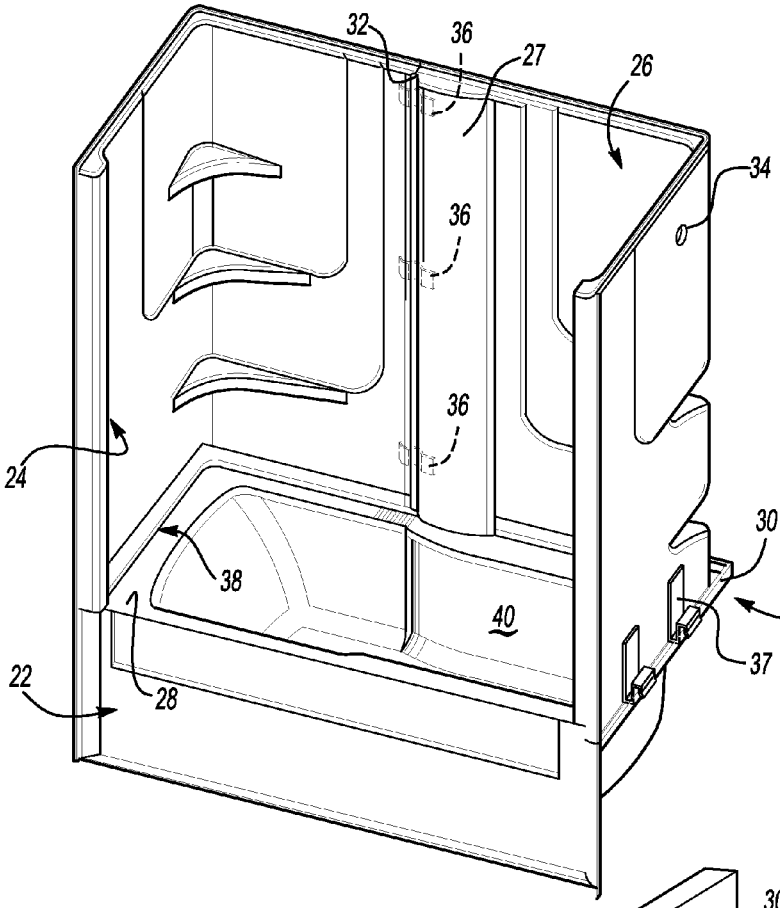
FIG. 1 is a general perspective view a molded tub and surround according to the present invention.
Figure 3:
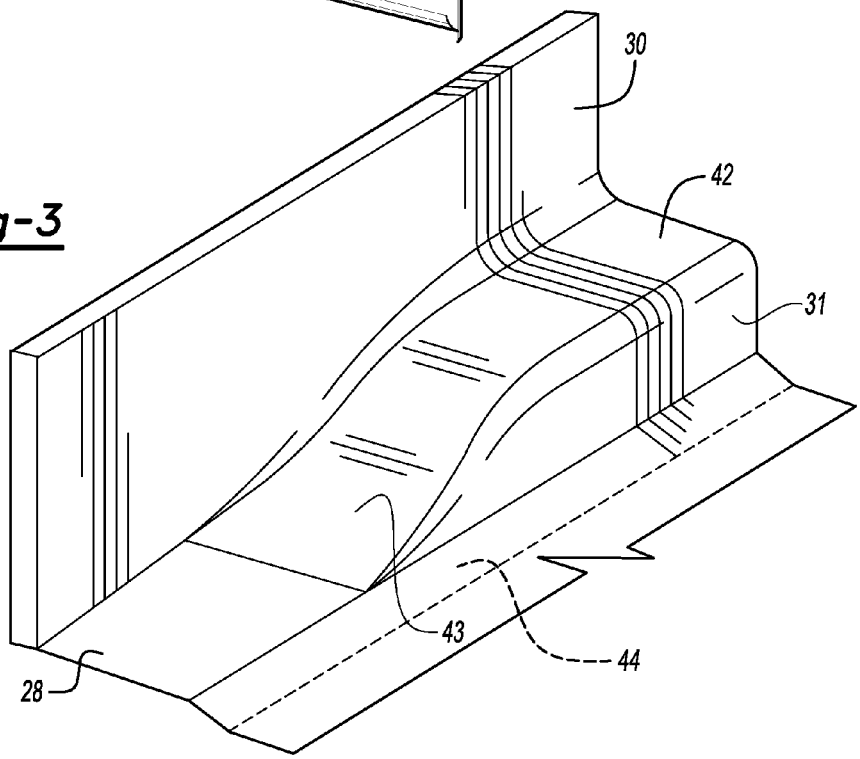
FIG. 3 is a further expanded view of the joint of FIG. 2.

FIG. 1 illustrates a general perspective view of a molded tub and surround 20 which is formed of three pieces of molded plastic. A tub portion 22 receives wall portions 24 and 26 to form the combined tub and surround 20. It should be understood that any number of wall portions will benefit from the present invention. The tub portion 22 defines a horizontal deck area 28 and a substantially vertical flange 30 extending therefore. The flange may also be known as a nailing flange has a vertical upwardly planar portion (see FIG. 3) from which ledge 42 originates from and extends transversely from without any intervening horizontal portions. The flange 30 preferably extends along three sides of the tub portion 22 behind the wall portions 24, 26 when in an assembled condition. It should be understood that the term "tub" is not limited to bath tubs only and that relatively shallow shower bases and the like will also benefit from the present invention.

A joint 32 is defined between the wall portions 24 and 26. A showerhead opening 34 is located within the wall 26 such that water will move in the direction of right to left in FIG. 1. That is, wall portion 26 is considered the "wet" wall as it is closer to showerhead opening 34. The wall portion 26 includes a partially arcuate portion 27 which engages wall portion 24 to define joint 32. A plurality of wall clamps 36 are spaced vertically along wall portion 26 to span the joint 28. Preferably, the wall clamps 36 are affixed to wall portion 26 through an adhesive or the like. It should be understood that various attachment devices such as clamps and fasteners will benefit from the present invention.

A joint 38 is also defined between the wall portions 24 and 26 and the deck 28 of the tub portion 22. The joint 38 is defined where the wall portions 24 and 26 meet the deck 28 between the flange 30 and the tub bowl 40. A plurality of tub clamps 37 are spaced along the flange 30 to maintain a predefined distance between the wall portions 24 and 26 and the flange 30. It should be understood that various attachment devices such as clamps and fasteners will benefit from the present invention.

Figure 2:
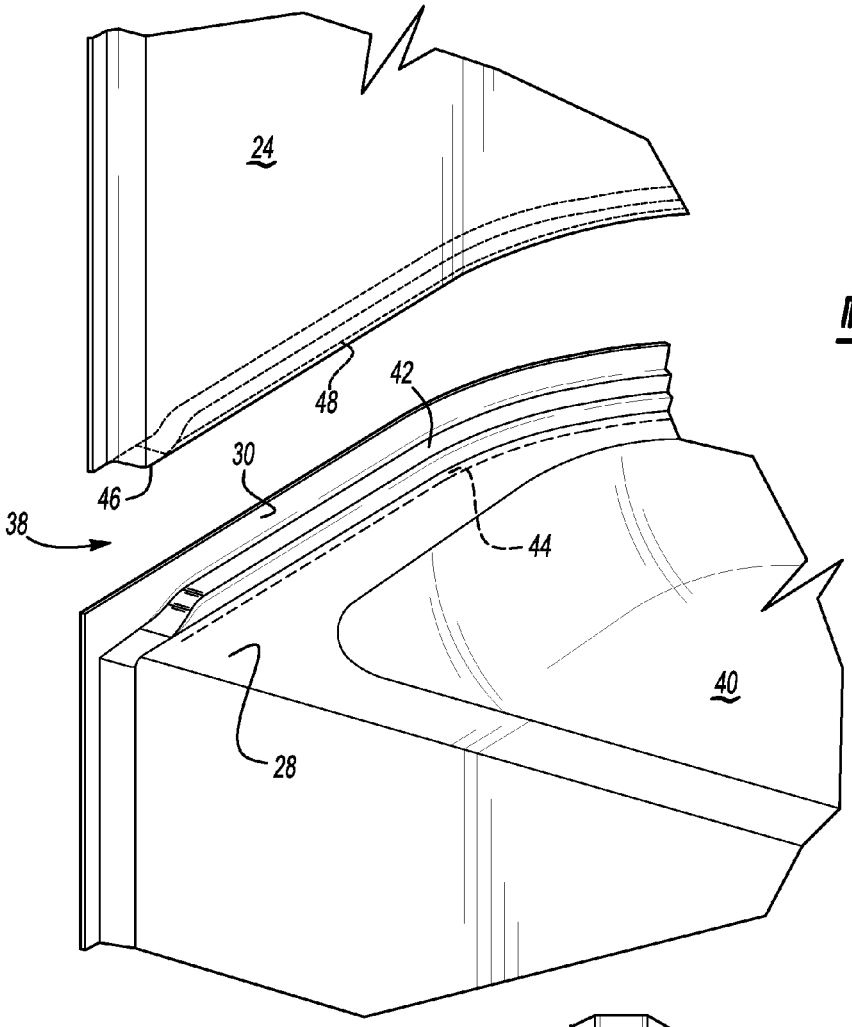
FIG. 2 is an expanded view of a joint.
Figure 4:
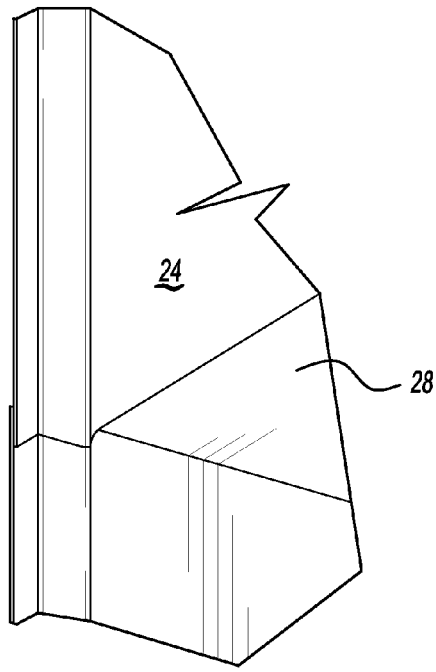
FIG. 4 is a perspective view of the joint in an assembled condition.

Referring to FIG. 2, the joint 38 is illustrated prior to assembly. The joint 38 includes a retaining ledge 42 and an angled interface surface 44 (also illustrated in FIG. 3). The retaining ledge 42 is a step extending inward toward the bowl 40 from the flange 30. That is, the retaining ledge 42 connects to and extends directly, without interruption in plane and horizontally from the flange 30 then turns approximately 90 degrees downward to meet the deck 28. Preferably, the ledge 42 extends less than an inch above the deck 28. The retaining ledge 42 and the flange 30 form an integral whole.

A ledge interface 46 within the bottom of the wall portions 24 and 26 preferably engages the ledge 42. Ledge interface 46 is effective the opposite of the ledge 42 to receive ledge 42 therein. A sealing compound such as caulking is applied to the ledge 42 prior to installation of the wall portions 24 and 26. The weight of the wall portions 24 and 26 compress the caulking to fill any potential voids therebetween. The height of the ledge 42 further provides a barrier to prevent water from pooling behind the wall portions 24 and 26 during and after usage. The potential for mold and mildew is thereby reduced. The ledge 42 has a wall 31 that is parallel to the flange 30 and extends downwardly from the ledge 42 and connects to the angled interface surface 44.

The retaining ledge 42 further operates to resist pressure exerted upon the lower portion of the wall portions 24 and 26 such as, for example only, should a person push upon the wall portions 24 and 26.

The angled interface surface 44 is located directly in front of the ledge 42, attaches to portion 31, and slopes downwardly therefrom toward the bowl 40. Preferably, the angled interface surface 44 slopes downward at an approximately 7 degree angle. It should be understood that any somewhat shallow angle will also benefit from the present invention. A shallow interface 48 within the bottom of the wall portions 24 and 26 confirms to and engages the angled interface surface 44. As the shallow interface 48 engages the angled interface surface 44 an exceeding tight joint is formed which prevents water infiltration. Moreover, as the angled interface surface 44 slopes downward toward the bowl 40, gravity. Ledge 42 has a tapered portion 43 that tapers towards the front of the tub surround surface. The tapered portion diminishes in height to the deck such that only one scam appears at a front of the tub (see FIG. 1 and 2).

The retaining ledge 42 and an angled interface surface 44 assure an effective watertight molded tub and surround 20 which is effectively invisible when installed. It should be understood that a sealing compound may additionally be located on both sides of joints 32, 38 to further assure watertight integrity.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A tub surround comprising:

a tub having a flange with an upwardly extending portion, a retaining ledge originating from, projecting transversely from and connected directly to said upwardly extending portion, a deck disposed below said retaining ledge and having an angled portion, and a wall adapted to engage said retaining ledge adjacent to said angled portion of said deck, wherein said wall is contiguous to said angled portion.

2. The tub surround as recited in claim 1, wherein said retaining ledge extends from said deck for a first distance and said flange extends from said deck for a second distance, said first distance less than said second distance.

3. The tub surround as recited in claim 1, wherein said retaining ledge comprises a step downward from said flange.

4. The tub surround as recited in claim 1, wherein said tub comprises a shower base.

5. The tub surround as recited in claim 1, wherein said retaining ledge extends perpendicularly from said deck at least partially about a periphery of a tub bowl.

6. The tub surround as recited in claim 1, wherein said retaining ledge extends perpendicular from said deck, said retaining ledge comprising a first surface which extends perpendicular from said flange and a second surface which extends from said deck to said first surface.

7. The tub surround as recited in claim 1, wherein said wall engages said retaining ledge in a generally vertical orientation generally perpendicular to said deck.

8. The tub surround of claim 1, wherein said wall further comprises a shallow recess for receiving and enclosing said retaining ledge therein and engaging said angled portion.

9. The tub surround of claim 1 wherein said retaining ledge further comprises a tapered portion that diminishes in height to said deck such that only one seam appears at a front of said tub.

10. A tub surround, said tub surround comprising:

a tub having a flange having an upwardly extending portion, a retaining ledge originating from, projecting transversely from and connected directly to said upwardly extending portion, a deck disposed below said retaining ledge and having an angled portion, and a wall adapted to engage said retaining ledge adjacent to said angled portion of said deck, wherein said retaining ledge further comprises a tapered portion that diminishes in height to said deck such that only one seam appears at a front of said tub, and wherein said wall further comprises a recess for receiving said retaining ledge and said tapered portion therein.

11. The tub surround of claim 1 wherein said retaining ledge extends horizontally from said flange.

12. The tub surround of claim 1 wherein said retaining ledge is integral with said flange.

13. The tub surround of claim 12 wherein said recess conforms to a shape of said retaining ledge.

* * * * *